United States Patent [19]

Bourgois

[11] Patent Number: 4,627,229

[45] Date of Patent: Dec. 9, 1986

[54] COMPACT STEEL CORD FOR IMPROVED TENSILE STRENGTH

[75] Inventor: Luc Bourgois, Waregem-Desselgem, Belgium

[73] Assignee: N.V. Bekaert S.A., Zwevegem, Belgium

[21] Appl. No.: 748,988

[22] Filed: Jun. 26, 1985

[30] Foreign Application Priority Data

Jul. 9, 1984 [GB] United Kingdom ..... 8417485
Oct. 22, 1984 [GB] United Kingdom ..... 8426654

[51] Int. Cl.[4] ..... D02G 3/48; D07B 1/06

[52] U.S. Cl. ..... 57/213; 57/230; 57/902; 152/556

[58] Field of Search ..... 57/200, 210, 212, 213, 57/214, 215, 230, 235, 3, 6, 9, 12, 13, 15, 311, 902; 152/356, 359

[56] References Cited

U.S. PATENT DOCUMENTS 4,349,063 9/1982 Kikuchi et al. ..... 57/212 X
4,470,251 9/1984 Bettcher ..... 57/230
4,488,587 12/1984 Umezawa et al. ..... 57/213 X

*Primary Examiner*—Donald Watkins
*Attorney, Agent, or Firm*—Schwartz, Jeffery, Schwaab, Mack, Blumenthal & Evans

[57] ABSTRACT

A steel cord for use in the reinforcement of resilient articles such as rubber tires has a core and one surrounding layer of wires, the diameter and twist pitch of the core wires being substantially different from the diameter and twist pitch of the wires of the layer surrounding the core. This construction eliminates wire migration without loss of reinforcing ability of the cord in the resilient material.

20 Claims, 5 Drawing Figures

COMPACT STEEL CORD FOR IMPROVED TENSILE STRENGTH

BACKGROUND

Field of the Invention

This invention relates to a rubber adherable steel cord adapted for reinforcement of resilient articles such as rubber hoses, rubber belts or vehicle tires.

Such cord will generally be a structure of steel wires, twisted appropriately, the wires having a diameter ranging from 0.03 to 0.80 mm, in general in the range from 0.14 to 0.40 mm, and the steel being in general carbon steel (preferably 0.65 to 0.95% carbon) in its ferritic state, having a tensile strength of at least 2000 $N/mm^2$ and an elongation at rupture of at least 1%, and preferably about 2%. The cord will generally further comprise, in order to obtain the necessary rubber adherability for reinforcement purposes, a rubber-adherable coating, such as copper, zinc, brass or ternary brass alloy, or a combination thereof, the coating having a thickness ranging from 0.05 to 0.40 micron, preferably from 0.12 to 0.22 micron. The coating can also be present in the form of a thin film of chemical primer material for ensuring good rubber penetration and adhesion.

The wires are twisted into a bundle according to a given structure, e.g. twisted strands or superposed layers, and this bundle may or may not be provided with a wrapping filament, helicoidally wound around the bundle. In defining below any twisting structure and number of filaments, this wrapping filament is not taken into consideration, and may or may not be present in addition.

For tire belt and carcass in particular, the requirements for a suitable cord structure are specifically: high tensile strength (which a.o. requires a structure with a minimum of cabling loss), good compactness (in order to obtain thin reinforcement plies, necessary specifically in the belt area of the tire), high fatigue resistance (by inter alia less fretting in the contact points between wires), and simple manufacturing method (for reduced costs). For this use, the cords generally have a steel cross-sectional area ranging from 0.5 to 3.5 $mm^2$ for heavy truck tires, and from 0.15 to 0.5 $mm^2$ for light truck tires.

For meeting these requirements, single-bundle $n \times 1$ structures have been proposed, e.g. $12 \times 1$-structure, in which all the wires are twisted in the same direction and with the same pitch. In these structures, the wires come to stack together in a compact configuration, contacting each other along a line instead of in cross-points, so that fretting is very low. The cord is also made in a simple way in a single twisting operation, and further shows a good resistance to cutting as reflected in an impact test. Such $12 \times 1$-cord can also be considered as having a core of three wires, surrounded by a layer of nine wires.

This cord however shows two major drawbacks. In the first place, it shows the phenomenon of "wire migration". The cords are generally used in practice in e.g. tire plies in the form of cut lengths of 35–55 cm, and in running tests of a tire, one or more wires have been found to shift lengthwise with respect to their neighbours, and emerge at one end of the cord, at one side of the ply over a certain length, puncturing through the rubber and damaging the tire. Secondly, it has been observed that the advantages of this cord are obtained at the expense of its reinforcing ability in rubber. The rupture strength of the bare cord, as obtained in an Instron tensile test, is normal. But when embedded in rubber, and measured between Zwick clamps, which take the cord by the rubber, and where the cord has to take up the tensile force from the rubber and redistribute this over the wires, the rupture strength is lower. This latter test corresponds more with the actual loading in the tire, and it shows that this cord is not as good for transmission of the tensile forces from the circumference wires to the core wires.

SUMMARY

It is an object of the present invention to provide a cord in which the mentioned advantages of the $n \times 1$ structures with a core and one surrounding layer are kept as much as possible, but where wire migration does not occur, and not at the expense of lower rupture strength of the embedded cord.

The cord according to the invention comprises a core of wires which are twisted together, and one surrounding layer, twisted in the same sense as the core and is characterized by the fact that, in combination, the twist pitch of the core is substantially different from the twist pitch of the surrounding layer, and that the diameter of the core wires is substantially larger than the diameter of the wires of the surrounding layer.

By a "layer" is meant a twisted assembly of wires in tubeform around a cylinder, which layer has a thickness of one wire diameter.

The minimum necessary degree of difference of diameter and twist pitch depends on the degree of desired resistance to wire migration, which is not an absolute value. As from a first departure from equality, an improved resistance to wire migration will result without loss of tensile strength of the embedded cord. In general, a difference in diameter of at least 0.5 percent of the core wire diameter will be taken, preferably in the range between 5 and 15 percent, and a difference of twist pitch of at least 5 times the core wire diameter will be taken. Preferably, the twist pitch of the core wires will range between 50 core wire diameters below, and 150 core wire diameters above the twist pitch of the surrounding layers.

BRIEF DESCRIPTION OF THE DRAWINGS

The invention will here further be illustrated by a number of drawings in which.

DETAILED DESCRIPTION

Figures 1, 2:
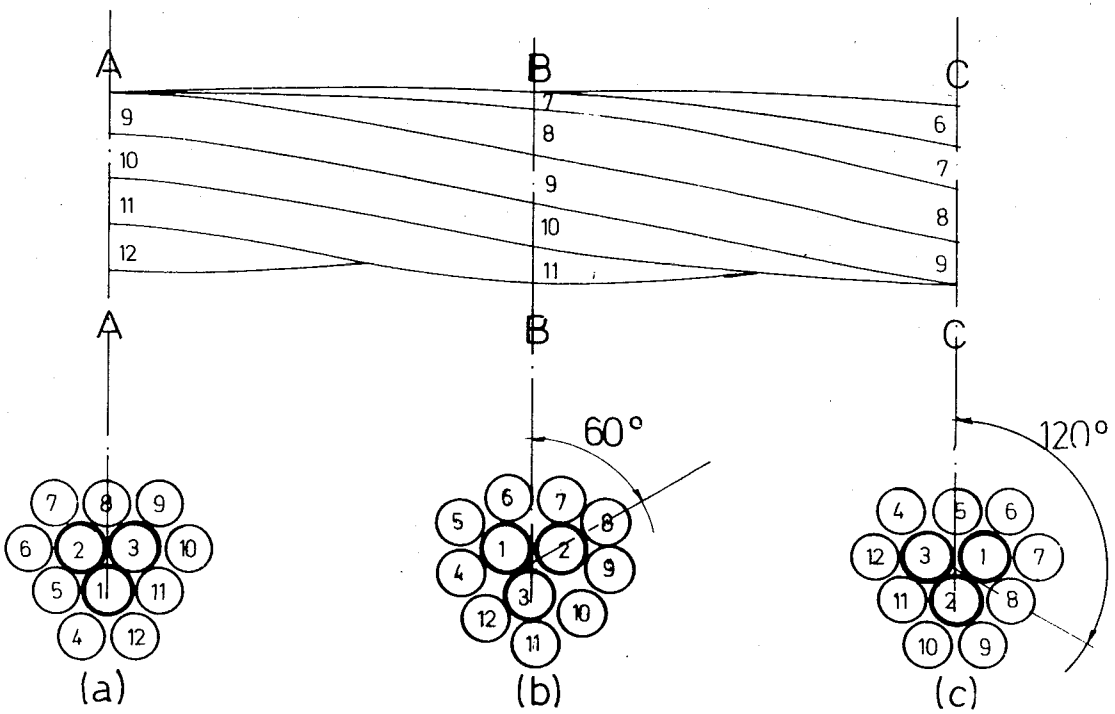
FIG. 1 is a side view of a cord according to the invention, with one surrounding layer.
FIG. 2 shows three cross-sections of the cord according to FIG. 1, taken at three different places.

FIG. 1 illustrates a side view of a cord according to the invention, having a core of three wires 1 to 3, and a surrounding layer of nine wires 4 to 12. The wires have a circular cross-section, those of the surrounding layer have a diameter of 0.22 mm and those of the core a diameter of 0.25 mm. The wires of the surrounding layer are twisted around the core wires with a twist pitch of 18 mm, and the core wires are twisted together with a twist pitch of 9 mm, in the same direction as in the surrounding layer. FIG. 2 shows three successive cross-sections of the cord, taken along the lines AA, BB and CC, at a distance of 3 mm from each other (or one sixth part of the pitch length of the surrounding layer).

At FIG. 2*a*, the wires arrange themselves into a compact configuration because, at this location AA, the triangular form of the core fits into the triangular form of the interior of the surrounding layer. But at the location BB, this is no longer true, because the configuration of the core has rotated by 120° and the configuration of the layers only by 60°. As a consequence, the wires are, at that location, no longer in a compact configuration. But three millimeter further on, at location CC, this is true again, because the configuration of the surrounding layers has rotated, with respect to the configuration at AA, by 120°, and the configuration of the core by 240°, which again allows the triangular form of the core to fit in the triangular form of the interior of the layers in a compact configuration.

The result is, that such cord still shows low fretting characteristics as for the corresponding 12×1-structure, because the contacts between the wires are still mainly line contacts and not point contacts. As can be seen on FIG. 2, the position of the wires in cross-section fluctuates from nearly compact configuration (FIG. 2*a*), over a less compact configuration (FIG. 2*b*), toward a nearly compact configuration again (FIG. 2*c*), which gives an average compactness which is still higher than the compactness of a 3+9-SZ-cord. But, and this will be shown in the tests hereinafter, this type of cord shows no migration and this appears not to be at the expense of loss of tensile strength of the embedded cord.

Figure 3:
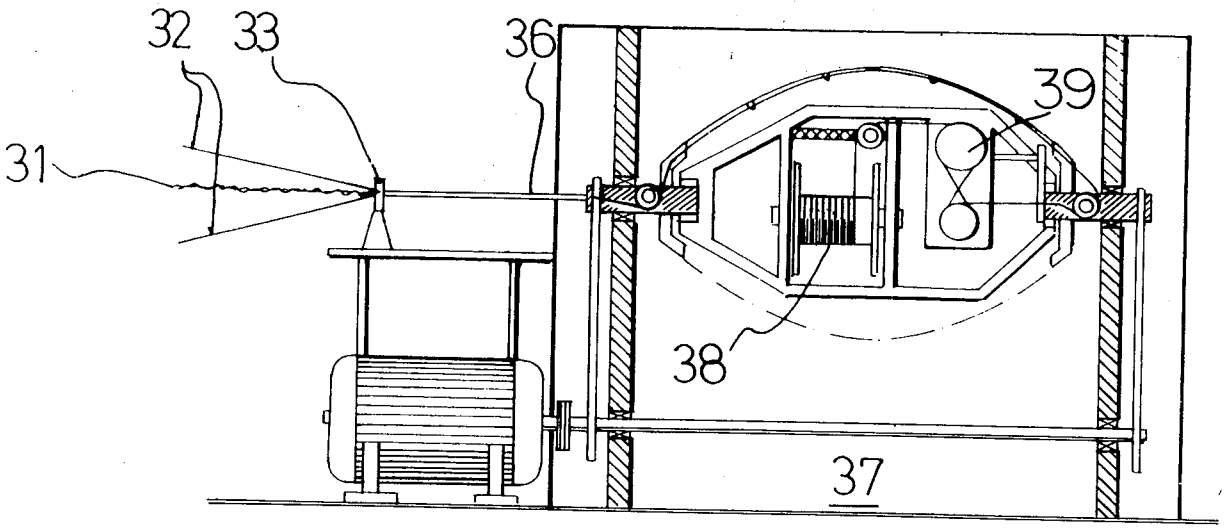
FIG. 3 is a view of a twisting machine of a cord according to the invention.

Such cord according to FIGS. 1 and 2 can e.g. be made by bundling together a central strand of three wires, twisted in the Z-direction with a pitch of 18 mm, with a surrounding ring of 9 parallel wires and introducing this bundle into a double-twist bunching machine, which gives the parallel wires a twist pitch p of 18 mm in the Z-direction, whereby the central strand becomes a core with a twist pitch of 9 mm. This is shown in FIG. 3, where the central strand 31 and the surrounding ring 32 of nine parallel wires is formed in a forming die 33 to form the bundle 36 of twelve wires which is introduced in the double-twister 37, well known in the art, towards the winding-up spool 38. The guiding elements defining the traveling path of the cord through the double-twister between the forming die 33 and the positively driven capstan 39 (which draws the cord through the double-twister) shall produce a minimum of friction, so that all torsions given in the twister travel back towards the exit of the forming-die 33, where the torsion operation is concentrated as much as possible.

The advantageous results appear from the following comparative tests. For all cords a steel wire was used comprising 0.72% carbon, 0.56% manganese and 0.23% silicon, the wire being hard drawn to a tensile strength of about 2900N/mm$^2$, and covered with a brass-layer (67.5% copper) of 0.25 micron thickness.

Cord No. 1 is a 3+9-SZ-cord, this means with a core of three wires twisted in the S-direction and a surrounding layer of nine wires twisted in the S-direction, all wires having the same diameter of 0.22 mm. The core and the surrounding layer have a twist pitch of 6.3 mm and 12.5 mm respectively. A wrapping wire of 0.15 mm diameter is laid around the cord with a pitch of 3.5 mm in the S-direction.

Cord No. 2 is a 12×1 compact cord with a twist pitch of 18 mm in the Z-direction, all wires having a diameter of 0.22 mm. A wrapping wire of 0.15 mm diameter is laid around the cord with a pitch of 3.5 mm in the S-direction.

Cord No. 3 is a sample according to the invention comprising a core of three wires of 0.25 mm diameter and twisted in the Z-direction with a pitch of 9.5 mm, surrounded by a layer of nine wires of 0.22 mm diameter and twisted in the Z-direction with a pitch of 18 mm.

These cords are tested to determine their breaking load, i.e. the tensile force to which the cord is submitted at rupture. In a first test, the breaking load of the bare cord is measured with both ends laid in loops along a cylindrical piece and the extremity then fixed to this piece. The free test length is 22 cm. In a second test, the cord is firstly vulcanized in a rubber beam of 40 cm length, 12 mm width and 5 mm thickness. The cord runs lengthwise over the whole length, and is located, in cross-section in the centre of the rectangular cross-section of the rubber. At each end of this beam, a length of 10 cm of the sample is clamped between two flat clamps, pressing the sample in the direction of its thickness, and a free test length of 22 cm is left between the clamps. In the test, the clamps are then moved away from each other. In this latter test, the tensile forces of the testing machine are imparted through the rubber towards the cord, which is a better simulation of the reinforcing effect of the cord in rubber. In order to eliminate differences in rupture strength, due to the fact that the embedded wire has undergone an ageing in the vulcanization operation, and the bare cord has not, this latter cord is, before the bare cord test, submitted to an ageing of 1 hour at 150° C.

In the results hereunder, the fretting figure is expressed as a percentage of loss of breaking load of the cord in an endless belt test after $40\times10^6$ cycles as described in the Special Technical Publication No. 694 of the American Society for Testing and Materials, 1980. The occurrence or absence of wire migration being given by an X and O respectively.

The results are given in the table below:

| Cord No. | Breaking load bare (N) | Breaking load embedded (N) | Fretting figure (%) | Wire migration |
|---|---|---|---|---|
| 1 | 1275 | 1370 | 7 ± 1 | O |
| 2 | 1290 | 1270 | 3.5 ± 1 | X |
| 3 | 1320 | 1335 | 3.1 ± 1 | O |

These results show that the cord according to the invention shows no wire migration without losing its reinforcing effect in rubber.

The invention is not limited to cords with a core of three wires and a surrounding layer of nine wires. The core of FIG. 2 can for instance comprise a number N of wires, N preferably ranging from 3 to 5, and the surrounding layer N+6 wires or, if desired, one or two wires less than N+6, in order to obtain some space between the wires for better rubber penetration.

I claim:

1. A rubber adherable steel cord adapted for reinforcement of resilient articles, comprising:

(a) a core of wires, each wire having a predetermined diameter, twisted together with a predetermined twist pitch, (b) a surrounding layer of wires, each wire having a predetermined diameter, twisted with a predetermined pitch in the same sense as the core, (c) the twist pitch of the core being substantially different from the twist pitch of the surrounding layer, and (d) the diameter of the core wires being substantially larger than the diameter of the wires of the surrounding layer.

2. A cord according to claim 1, in which said core comprises a number of N wires, N ranging from 3 to 5, said surrounding layer comprising N+6-n wires, n ranging from 0 to 2.

3. The cord according to claim 1 wherein the diameter of the core wires is about 0.25 mm.

4. The cord according to claim 1 wherein the diameter of the wires of the surrounding layer is about 0.22 mm.

5. The cord according to claim 4 wherein the diameter of the core wires is about 0.25 mm.

6. The cord according to claim 1 wherein the pitch of the core wires is about 9 mm.

7. The cord according to claim 1 wherein the pitch of the core wires is about 9.5 mm.

8. The cord according to claim 1 wherein the pitch of the surrounding layer is about 18 mm.

9. The cord according to claim 8 wherein the pitch of the core wires is about 9 mm.

10. The cord according to claim 1 wherein the diameter of the core wires is about 0.25 mm, the diameter of the wires of the surrounding layers is about 0.22 mm, the pitch of the core wires is about 9 mm, and the pitch of the surrounding layers is about 18 mm.

11. A vehicle tire reinforced with lengths of rubber adherable cord comprising:

(a) a core of wires, each wire having a predetermined diameter, twisted together with a predetermined twist pitch, (b) a surrounding layer of wires, each wire having a predetermined diameter, twisted with a predetermined pitch, in the same sense as the core, (c) the twist pitch of the core being substantially different from the twist pitch of the surrounding layer, and (d) the diameter of the core wires being substantially larger than the diameter of the wires of the surrounding layer.

12. A vehicle tire according to claim 11 in which said core comprises a number of N wires, N ranging from 3 to 5, said surrounding layer comprising N+6-n wires, n ranging from 0 to 2.

13. A vehicle tire according to claim 11 wherein the diameter of the core wires is about 0.25 mm.

14. A vehicle tire according to claim 11 wherein the diameter of the wires of the surrounding layer is about 0.22 mm.

15. A vehicle tire according to claim 14 wherein the diameter of the core wires is about 0.25 mm.

16. A vehicle tire according to claim 11 wherein the pitch of the core wires is about 9 mm.

17. A vehicle tire according to claim 11 wherein the pitch of the core wires is about 9.5 mm.

18. A vehicle tire according to claim 11 wherein the pitch of the surrounding layer is about 18 mm.

19. A vehicle tire according to claim 18 wherein the pitch of the core wires is about 9 mm.

20. A vehicle tire according to claim 11 wherein the diameter of the core wires is about 0.25 mm, the diameter of the wires of the surrounding layers is about 0.22 mm, the pitch of the core wires is about 9 mm, and the pitch of the surrounding layers is about 18 mm.

* * * * *